US005845819A

United States Patent [19]

de Pous

[11] Patent Number: 5,845,819

[45] Date of Patent: Dec. 8, 1998

[54] METHOD AND DEVICE FOR FIXING A METERING MEMBER IN A RECEPTACLE CONTAINING A SUBSTANCE TO BE DISPENSED

[75] Inventor: Olivier de Pous, Paris, France

[73] Assignee: Valois S.A., Neuborg, France

[21] Appl. No.: 737,003

[22] PCT Filed: Apr. 18, 1995

[86] PCT No.: PCT/FR95/00501

§ 371 Date: Mar. 10, 1997

§ 102(e) Date: Mar. 10, 1997

[87] PCT Pub. No.: WO95/29760

PCT Pub. Date: Nov. 9, 1995

[30] Foreign Application Priority Data

Apr. 29, 1994 [FR] France ..... 94 05212

[51] Int. Cl.[6] ..... B67D 5/40

[52] U.S. Cl. ..... 222/321.9; 222/385

[58] Field of Search ..... 222/327.9, 385

[56] References Cited

U.S. PATENT DOCUMENTS

| | | | |
|---|---|---|---|
| 3,257,961 | 6/1966 | Schlenker | 222/321.9 X |
| 3,500,760 | 3/1970 | Schlenker | 222/321.9 X |
| 4,899,913 | 2/1990 | Ruscitti et al. | 222/321.9 X |
| 5,271,532 | 12/1993 | Jumel et al. | 222/321.9 |
| 5,277,340 | 1/1994 | Van Brocklin | 222/385 X |

FOREIGN PATENT DOCUMENTS

| | | | |
|---|---|---|---|
| 408 421 | 1/1991 | European Pat. Off. . | |
| 453357 | 10/1991 | European Pat. Off. | 222/321.9 |
| 583 193 | 2/1994 | European Pat. Off. . | |
| 31 22 982 | 12/1982 | Germany . | |

*Primary Examiner*—Kenneth Bomberg
*Attorney, Agent, or Firm*—Sughrue, Mion, Zinn, Macpeak & Seas, PLLC

[57] ABSTRACT

A fixing method and device for fixing a metering member (3) including a cylindrical body (4) in a receptacle (1) including a cylindrical neck (2). The receptacle contains a substance to be dispensed. The outside diameter of the body of the metering member is slightly smaller than the inside diameter of the neck of the receptacle, and the body of the metering member is held securely in the neck by a cylindrical ferrule (6) whose outside diameter is slightly greater than the inside diameter of the body of the metering member, the ferrule being engaged as a force-fit inside the body of the metering member at the neck of the receptacle.

11 Claims, 2 Drawing Sheets

METHOD AND DEVICE FOR FIXING A METERING MEMBER IN A RECEPTACLE CONTAINING A SUBSTANCE TO BE DISPENSED

BACKGROUND OF THE INVENTION

The present invention relates to a method and to a device for fixing a metering member in a receptacle containing a substance to be dispensed, and it applies more particularly to dispensers for dispensing small quantities, such as samples of perfume, cosmetics, or pharmaceuticals.

It is known, e.g. from documents EP-0 408 421 and EP-0 583 193, to use a ring for mounting the pump body on the receptacle. That system suffers from certain drawbacks and in particular it requires a mounting operation that is relatively expensive given the nature of the receptacles (samples).

Another known system, disclosed in U.S. Pat. No. 5,271,532, avoids that drawback by providing a pump body that is dimensioned so as to be capable of being inserted as a force-fit in the receptacle. Under such circumstances, there is no need for a ring. To ensure that the pump is put into place properly, its body includes a bottom portion whose outside diameter is smaller than the diameter of the neck of the receptacle. Clamping takes place at the neck which receives the top portion of the pump body as a force-fit, which portion must have an outside diameter that is slightly greater than the diameter of said neck. That device also suffers from drawbacks. Thus, since clamping is provided by the pump body itself, its dimensions and in particular its outside diameter need to be very accurate, and that gives rise to extra manufacturing costs. Also, said pump body must be of complex outside shape with different outside diameters. Further, the diameters of the necks of receptacles, and in particular receptacles made of glass, can vary slightly from manufacture and that can prevent the pump body being fixed properly in said neck of the receptacle. Also, engaging the pump body itself as a force-fit can in some cases cause the pump body to be constricted, giving rise to friction inside the pump that can spoil its operation.

Another device, disclosed in document DE-31 22 982, provides for the pump body to be snap-fastened to a rim on the neck of the receptacle. That device suffers from the drawback of requiring the receptacle to have a special neck and it is not adaptable to a standard neck.

SUMMARY OF THE INVENTION

An object of the present invention is to avoid the above-mentioned drawbacks by providing a fixing device that is simple and cheap, enabling the body of a metering member to be fixed in the neck of a receptacle, it being possible for the radial dimensions of the body of the metering member and of the neck of the receptacle to vary slightly without influencing the possibility and/or the quality of fixing.

The present invention thus provides a fixing device for fixing a metering member including a cylindrical body whose top portion is terminated by a flange in a cylindrical neck of a receptacle containing a substance to be dispensed, the device being characterized in that said body of the metering member has an outside diameter that is slightly smaller than the inside diameter of said cylindrical neck of the receptacle and comes into abutment on the top end of said neck of the receptacle via said flange, said device comprising a cylindrical ferrule whose outside diameter is slightly greater than the inside diameter of said body of the metering member over at least a portion of its length, said ferrule being engaged by force in said body of the metering member at the neck of the receptacle.

The device of the invention presents numerous advantages: the pump body may be of very simple general configuration, no longer requiring an outside shape that is complex and of dimensions that are very accurate. Manufacturing cost is thus reduced. Also, the invention is adaptable to standard necks and does not require any special additional structure. Finally, the pump body is fixed directly in the neck, thereby avoiding the use of a screwed or crimped ring.

Preferably, said body of the metering member includes at its top end a portion of slightly greater inside diameter so as to enable the ferrule to be pre-engaged prior to being fully engaged by force. It is thus possible to deliver the assembly with the ferrule pre-engaged, the customer merely having to push it home.

Advantageously, said ferrule is chamfered at its bottom end to facilitate engagement thereof in the body of the metering member.

Advantageously, said ferrule includes at its top end a head that comes into abutment with the flange of the body of the metering member when the ferrule is fully engaged in said body of the metering member.

Preferably, said head of the ferrule is such that it does not create extra thickness on the flange of the body of the metering member when the ferrule is fully engaged in said body of the metering member.

In a particular embodiment of the invention, the material of the body of the metering member is more flexible than the material of the ferrule.

In an embodiment of the present invention, the length of said ferrule is approximately equal to the length of the neck of the receptacle.

In another embodiment, the length of said ferrule is greater than the length of the neck of the receptacle, the ferrule being a force-fit level with the bottom end of said neck thus causing material to be displaced beneath the wall of the receptacle where it flares away from said neck, thereby locking the body of the metering member in said receptacle and sealing the device.

Generally, said metering member is a pump.

The present invention also provides a method of fixing a metering member comprising a cylindrical body whose top portion is terminated by a flange in a cylindrical neck of a receptacle containing a substance to be dispensed, the outside diameter of said body of the metering member being slightly smaller than the inside diameter of said neck of the receptacle, said method comprising the following steps:

inserting the body of the metering member in the neck of the receptacle until said flange of the body of the metering member comes into abutment against the top end of said neck of the receptacle, said body of the metering member not being tight in said neck of the receptacle; and engaging a cylindrical ferrule as a force-fit in the body of the metering member, the outside diameter of said ferrule being slightly greater than the inside diameter of said body of the metering member over at least a portion of its length so as to fix said body of the metering member which becomes tight in the neck of the receptacle.

Advantageously, the step of engaging the ferrule as a force-fit is preformed by exerting thrust on a dispenser element after it has been put into place on the metering member.

BRIEF DESCRIPTION OF THE DRAWINGS

Other advantages and characteristics of the present invention appear from the following description of an embodiment of the invention, given by way of non-limiting example and with reference to the accompanying drawings.

In the drawings.

DETAILED DESCRIPTION OF THE PREFERRED EMBODIMENTS

Figure 1:
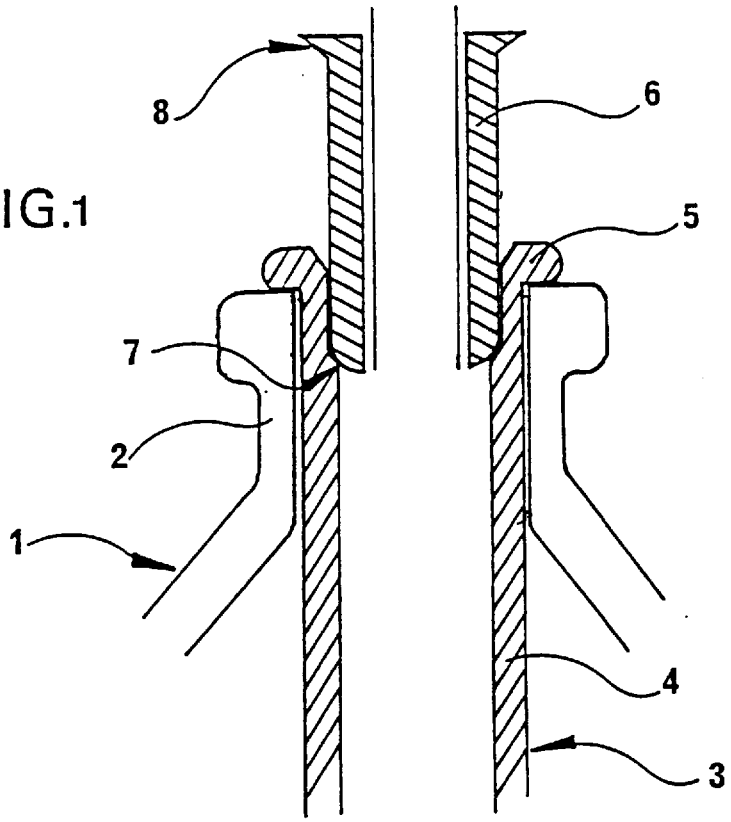
FIG. 1 is a diagrammatic view of a fixing device constituting a first embodiment of the invention prior to being assembled.

With reference to the drawings, the metering assembly of the present invention comprises a receptacle 1 having a cylindrical neck 2 and containing a substance to be dispensed. The receptacle may be of arbitrary shape and made of any material, in general glass or a plastics material. To dispense the substance contained in the receptacle, a metering member 3 is provided, said metering member 3 having a substantially cylindrical body 4. Advantageously, said metering member 3 is a pump enabling substance to be dispensed selectively. According to the present invention, the outside diameter of said body 4 of the metering member 3 is slightly smaller than the inside diameter of said cylindrical neck 2 of the receptacle 1. Thus, the body 4 of the metering member 3 can easily be inserted into the receptacle 1 and it is not tight in the neck 2 of said receptacle 1. The body 4 of the metering member has a flange 5 at its top end which comes into abutment with the top end of the neck 2 of the receptacle 1 when the metering member is fully inserted into the receptacle 1. In this position, the metering member is held with a certain amount of play in the neck of the receptacle. A particular advantage lies in the fact that the body 4 of the metering member 3 can be perfectly cylindrical, being of identical section over its entire length, thereby making manufacture of the metering member simple, and thus cheap.

Once the metering member 3 has been put into place inside the receptacle 1, a substantially cylindrical ferrule 6 is inserted into the body of the metering member 3. The outside diameter of said ferrule 6 is Preferably slightly greater than the inside diameter of the body 4 of the metering member 3 over at least a portion of its length, and the ferrule 6 is thus a force-fit in said body 4. When the ferrule 6 is put into place, the body 4 of the metering member 3 becomes tight within the neck 2 of the receptacle 1, either over the full height of the neck 2, or else locally, with this being achieved by deforming the material from which said body 4 is made where the ferrule is engaged by force.

Advantageously, the top end of the body 4 of the metering member 3 has a portion of slightly larger inside diameter. This makes it possible to pre-engage the ferrule 6 in the body of the metering member prior to delivering the assembly, with the ferrule being pushed home by force on the customer's premises, e.g. after the receptacle has been filled.

Figure 2:
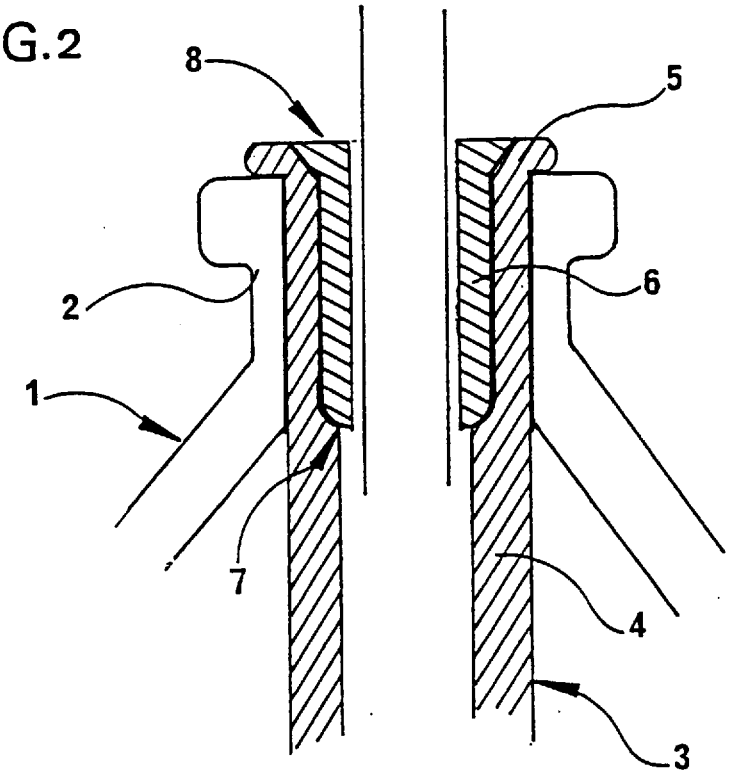
FIG. 2 is a diagrammatic view of the FIG. 1 device after being assembled.

Various lengths of ferrule 6 are possible. In an embodiment as shown in FIGS. 1 and 2, the length of the ferrule is approximately equal to the length of the neck 2 of the receptacle 1, with the force-fit taking place inside the neck 2 of the receptacle itself.

Figure 3:
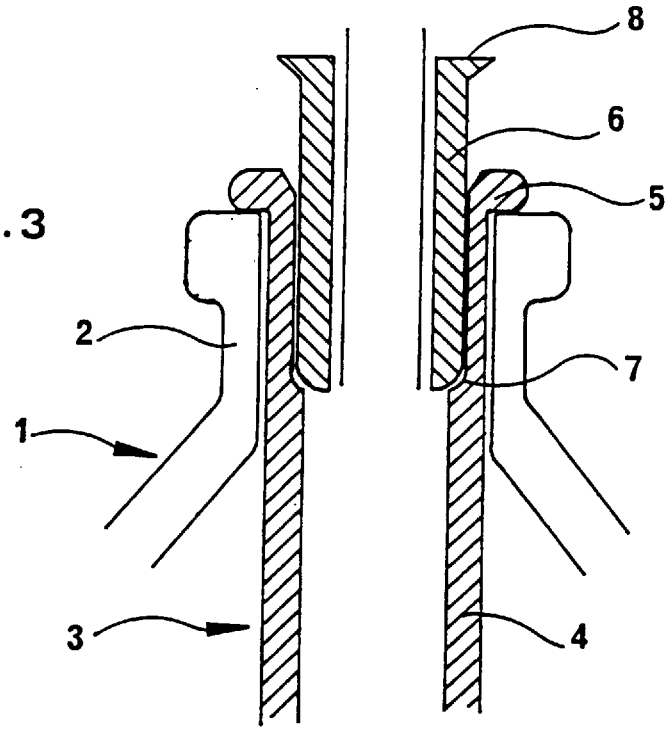
FIG. 3 is a diagrammatic view of a fixing device constituting a second embodiment of the invention prior to being assembled.
Figure 4:
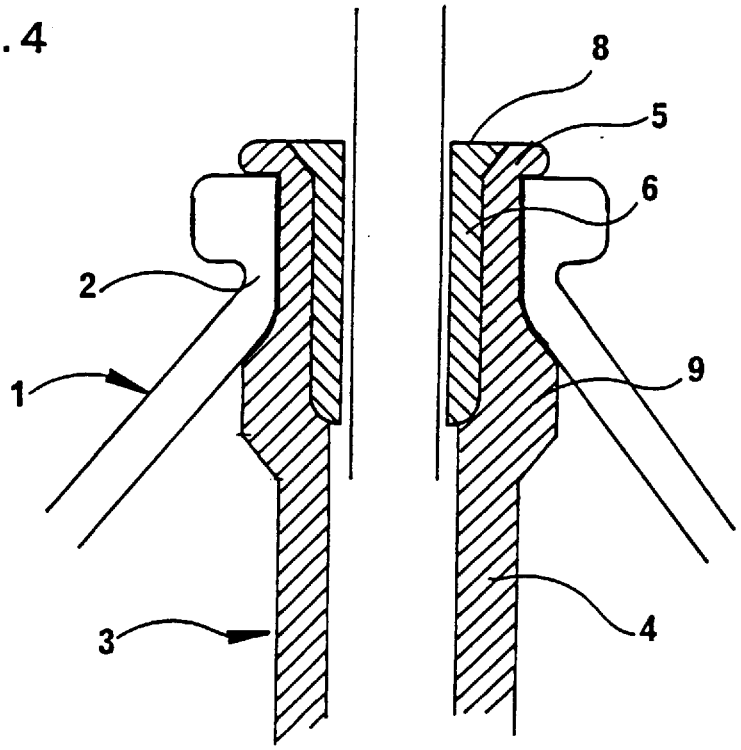
FIG. 4 is a diagrammatic view of the FIG. 3 device after being assembled.

In another embodiment, shown in FIGS. 3 and 4, the ferrule 6 is longer than the neck 2 of the receptacle 1, and the portion of the body of the metering member which is of smaller inside diameter is situated at the bottom end of said neck 2. Thus, forced engagement of the ferrule 6 causes material 9 to be pushed out beneath the wall of the receptacle 1 where it flares away from said neck 2. This displacement of material locks the body of the metering member in the neck of the receptacle and also provides sealing for the device.

In a particular embodiment, the ferrule 6 is chamfered at its bottom end 7 to facilitate insertion into the body 4 of the metering member 3, and its top end has a head 8 that comes into abutment with said flange 5 of the body of the metering member when the ferrule has been fully engaged in said body of the metering member.

Said head 8 of the ferrule 6 is preferably made so as to co-operate with the flange 5 of the body of the metering member 3 in such a manner as to avoid creating extra thickness on said flange 5 after the ferrule has been fully engaged.

Advantageously, the material from which the body 4 of the metering member 3 is made is more flexible than that of the ferrule 6. This makes forced engagement easier and avoids possible jamming of the valve of the metering member, assuming it is a pump, as might happen if the ferrule 6 were to deform. Also, deformation of the material constituting the body of the metering member makes it possible to compensate for manufacturing tolerances concerning the neck 2 of the receptacle 1.

According to the invention, the ferrule 6 is put into place, i.e. it is forced home, either by means of a tool pressing against the head 8 of said ferrule 6, or else by exerting a thrust force on a dispensing element, e.g. a pushbutton, previously fixed on the metering member 3.

It is claimed:

1. A mounting arrangement for fixing a metering member (3) in a receptacle (1), said arrangement comprising:

a) a receptacle having a cylindrical neck (2) and containing a substance to be dispensed, b) a metering member having a cylindrical body (4) with a top portion terminated by a flange (5), the metering member body having an outside diameter slightly smaller than an inside diameter of said cylindrical neck of the receptacle and abutting a top end of said neck via said flange, and c) a cylindrical ferrule (6) having an outside diameter slightly greater than an inside diameter of the metering member body over at least a portion of the ferrule length, said ferrule being engaged by force in the metering member body at the neck of the receptacle.

2. A mounting arrangement according to claim 1, wherein the metering member body includes, at a top end portion, a length of slightly greater inside diameter to enable the ferrule to be pre-engaged prior to being fully engaged by force.

3. A mounting arrangement according to claim 1, wherein said ferrule is chamfered at a bottom end thereof to facilitate engagement thereof in the body of the metering member.

4. A mounting arrangement according to claim 1, wherein said ferrule includes, at a top end thereof a head (8) that comes into abutment with the flange of the body of the metering member when the ferrule is fully engaged in said body of the metering member.

5. A mounting arrangement according to claim 4, in which said head of the ferrule is configured such that it does not create extra thickness on the flange of the body of the metering member when the ferrule is fully engaged in said body of the metering member.

6. A mounting arrangement according to claim 1, wherein a material of the body of the metering member is more flexible than a material of the ferrule.

7. A mounting arrangement according to claim 1, a length of said ferrule is approximately equal to a length of the neck of the receptacle.

8. A mounting arrangement according to claim 1, wherein a length of said ferrule is greater than a length of the neck of the receptacle, a bottom end of the ferrule being level with a bottom end of said neck and causing material (9) to be displaced beneath a wall of the receptacle which flares away from said neck, thereby locking the body of the metering member in said receptacle and sealing the device.

9. A mounting arrangement according to claim 1, wherein the metering member (3) is a pump.

10. A method of fixing a metering member (3) comprising a cylindrical body (4) having a top portion terminated by a flange (5) in a cylindrical neck (2) of a receptacle (1) containing a substance to be dispensed, an outside diameter of said body of the metering member being slightly smaller than an inside diameter of said neck of the receptacle, said method comprising the following steps:

a) inserting the body of the metering member in the neck of the receptacle until said flange of the body of the metering member comes into abutment against a top end of said neck of the receptacle, said body of the metering member not being tight in said neck of the receptacle; and b) force fitting a cylindrical ferrule (6) in the body of the metering member, an outside diameter of said ferrule being slightly greater than an inside diameter of said body of the metering member over at least a portion of the ferrule length so as to expand said body of the metering member such that it becomes tight in the neck of the receptacle.

11. A method of fixing according to claim 10, wherein the step of force fitting the ferrule is preformed by exerting thrust on a dispenser element after the ferrule has been put into place on the metering member.

* * * * *